US006547523B2

(12) United States Patent
Nelligan

(10) Patent No.: US 6,547,523 B2
(45) Date of Patent: Apr. 15, 2003

(54) DIAPHRAGM SCREW SUPPORT FOR AND METHOD OF SUPPORTING A TURBINE DIAPHRAGM

(75) Inventor: James Patrick Nelligan, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/949,817

(22) Filed: Sep. 12, 2001

(65) Prior Publication Data

US 2003/0049123 A1 Mar. 13, 2003

(51) Int. Cl.[7] ..... F01D 9/04
(52) U.S. Cl. ..... 415/209.2; 415/213.1; 415/214.1
(58) Field of Search ..... 415/209.2, 213.1, 415/214.1

(56) References Cited

U.S. PATENT DOCUMENTS

| | | | | | |
|---|---|---|---|---|---|
| 2,247,423 | A | * | 7/1941 | Webster, Jr. | 415/209.2 |
| 3,861,827 | A | * | 1/1975 | Peabody et al. | 415/209.2 |
| 4,204,803 | A | * | 5/1980 | Leger et al. | 415/209.2 |
| 6,352,405 | B1 | * | 3/2002 | Tomko | 415/209.2 |

* cited by examiner

*Primary Examiner*—Ninh Nguyen
(74) *Attorney, Agent, or Firm*—Nixon & Vanderhye

(57) ABSTRACT

A system for supporting bolted upper and lower diaphragms to one another in an outer housing of a turbine includes support screws threaded into bores adjacent opposite sides of the lower shell. The head of each support screw has a threaded bore receiving a set screw. The set screw has a length equal to the depth of the slot in which the head resides in the lower shell, minus a small clearance. With the diaphragms supported by the engagement of the set screw at the lower end with an abutment at the bottom of the slot, the clearance enables the diaphragms to move vertically upwardly, limited by the clearance distance.

14 Claims, 2 Drawing Sheets

DIAPHRAGM SCREW SUPPORT FOR AND METHOD OF SUPPORTING A TURBINE DIAPHRAGM

BACKGROUND OF THE INVENTION

The present invention relates to a system for supporting nozzle diaphragms in turbines enabling the nozzle diaphragms to be secured to one another along the horizontal midline joint and particularly relates to a support system for nozzle diaphragms enabling limited, generally vertical displacement of the diaphragms relative to the outer housing.

Screw support systems presently employed to support turbine diaphragms from the outer housing in certain turbines do not permit the upper and lower diaphragm sections to be secured or bolted to one another at the horizontal joint. Because of this, there is a potential for steam leakage across the horizontal joint of the nozzle diaphragm. In these prior screw support systems, a support screw is threaded into the opposite sides of the lower diaphragm adjacent the horizontal midline joint. The head of the support screw is internally threaded and receives a set screw. When the lower diaphragm is disposed in the lower shell of the housing, the head of the support screw and the set screw are received in a slot of the lower shell. The bottom of the set screw rests on a support surface of the lower shell, supporting the lower diaphragm within the shell.

With the upper shell of the housing inverted, the upper diaphragm is disposed within the upper shell. A lug is inserted into a slot along the edge of the upper diaphragm adjacent the midline horizontal joint. The lug is bolted to the upper shell. An adjustable set screw is threaded into a threaded opening in the upper diaphragm. Upon inversion of the upper shell and diaphragm for completing the assembly of the turbine, the upper diaphragm rests on the lower diaphragm at the horizontal midline with a clearance between the upper end of the set screw and the lower face of the lug. This clearance, for example, on the order of 0.005–0.007", enables displacement of the upper and lower diaphragms relative to the housing, limited only by the clearance between the set screw and the lug. With the upper and lower diaphragms not directly secured to one another, there is a potential for steam leakage at the horizontal mid-joint between the diaphragm halves.

BRIEF DESCRIPTION OF THE INVENTION

In accordance with a preferred embodiment of the present invention, the upper and lower diaphragm halves may be secured, for example, by bolts to one another to minimize or eliminate the potential for steam leakage therebetween, while enabling the diaphragm for vertical displacement relative to the housing. To accomplish this, the upper lugs, bolts and set screws at opposite sides of the joint midline, as previously required, are entirely eliminated. Rather, only a support screw and set screw are provided adjacent each of the opposite sides of the lower diaphragm. Particularly, at each opposite side of the lower diaphragm, a support screw threads into the lower diaphragm and has a head with an internally threaded bore for receiving an elongated set screw. The set screw is dimensioned such that the depth of the slot in the outer shell which receives the set screw exceeds the length of the set screw by the predetermined clearance, for example, 0.005–0.007". That is, the set screw is sized to the depth of the slot less 0.005–0.007".

When installing the diaphragms, the upper and lower diaphragms are first bolted to one another. With the set screws in the threaded bores of the support screws previously threaded into the lower diaphragm, the lower diaphragm is set in the lower shell. The lower end of the set screw supports the upper and lower diaphragms within the lower shell. The upper shell is then disposed about the upper diaphragm and bolted to the lower shell at the horizontal midline, leaving a clearance between the upper end of the set screw and the horizontal midline joint face of the upper shell. Consequently, the diaphragms are supported by the set screws and the clearance limits the vertical displacement of the diaphragm halves relative to the housing.

In a preferred embodiment according to the present invention, there is provided a support system for diaphragms of a turbine, comprising upper and lower diaphragms secured to one another along a horizontal midline, a turbine housing including upper and lower outer shells for securement to one another along a midline and in surrounding relation to the diaphragms, support cooperable between the lower diaphragm and the lower shell adjacent the midlines of the shells and diaphragms, respectively, for supporting the diaphragms within the housing, each support including a set screw adjustable to provide a predetermined clearance between the set screw and a portion of the upper shell, enabling generally vertical joint movement of the upper and lower diaphragms relative to the surrounding housing, the set screw being engageable with the upper shell portion upon upward displacement of the upper and lower diaphragms within the housing to limit displacement thereof to the clearance.

In a further preferred embodiment according to the present invention, there is provided a method of supporting upper and lower diaphragms joined one to the other adjacent a horizontal midline joint and disposed within a housing having upper and lower shells surrounding the diaphragms and joined to one another adjacent a horizontal midline, comprising the steps of supporting the upper and lower diaphragms from supports projecting outwardly along opposite sides of the lower diaphragm and engaging the lower shell and limiting upper displacement of the upper and lower diaphragms within the housing by spacing an element carried by the lower diaphragm a predetermined clearance from a stop carried by the upper shell.

DETAILED DESCRIPTION OF THE INVENTION

Figure 1:
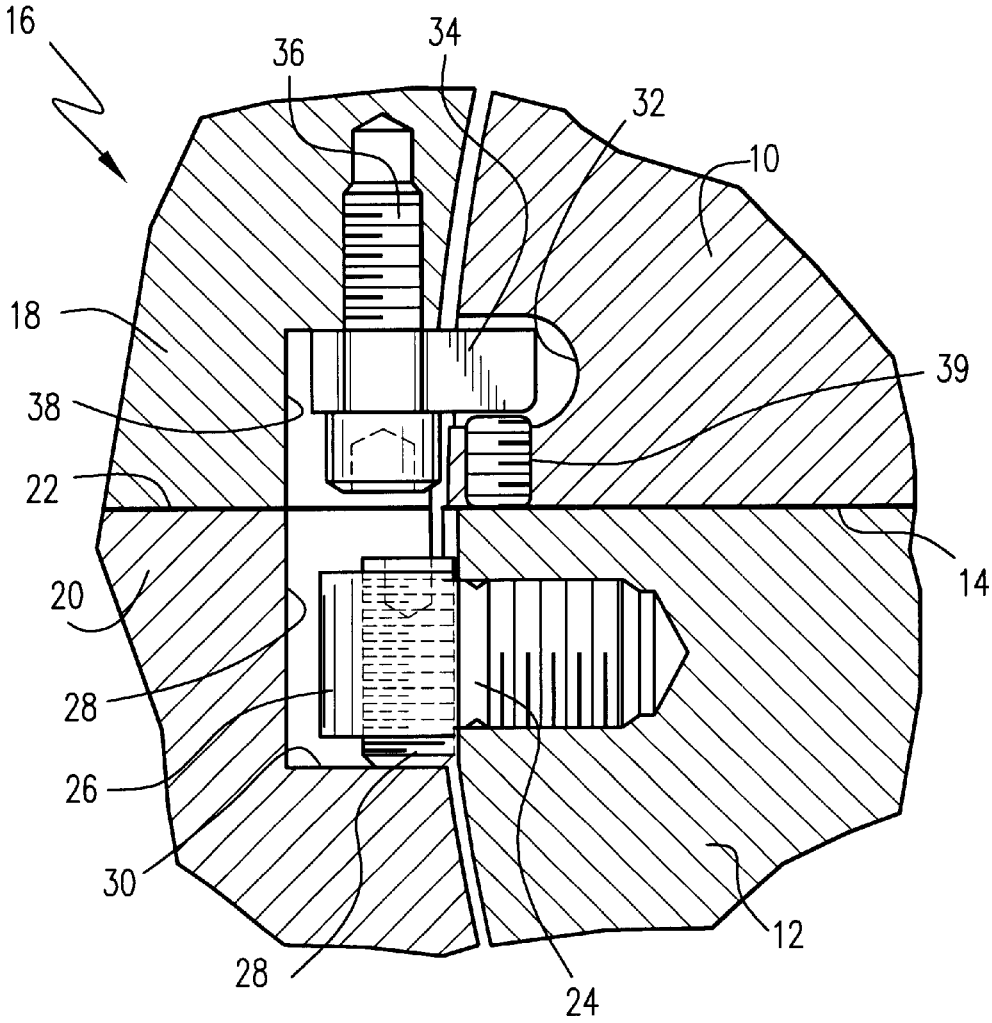
Fig.1 (PRIOR ART)
FIG. 1 is a fragmentary cross-sectional view of a support system for the upper and lower diaphragms within a turbine housing according to the prior art.

Referring now to FIG. 1, there is illustrated a prior support system for upper and lower diaphragms 10 and 12, respectively, of a turbine. It will be appreciated that the diaphragms together mount a circular array of nozzles comprising a plurality of fixed stator vanes through which combustion products may flow in a gas turbine or steam in a steam turbine. The diaphragms are illustrated as lying in contact with one another along a horizontal midline joint 14. Also illustrated in FIG. 1 is a housing, generally designated 16, comprising upper and lower shells 18 and 20, respectively. It will be appreciated that the housing 16 surrounds the diaphragms 10 and 12 and that the upper and lower shells 18 and 20 are secured to one another, for example, by bolts, not shown, along a horizontal midline 22. In this prior art arrangement, it will be appreciated that the upper and lower diaphragms 10 and 12 are not secured to one another and that the upper diaphragm 10 rests on the lower diaphragm 12 along the horizontal midline. Also, the diaphragms 10 and 12 are mounted for limited, generally vertical displacement relative to the housing 16.

This screw support system of the prior art includes a support screw 24 threaded into a threaded aperture along each side of the lower diaphragm. Each support screw 24 has a head 26 projecting laterally from the lower diaphragm into a slot 28 opening through the midline 22 of the lower shell 20 and through the inner wall of lower shell 20. The head 26 has a vertically threaded bore which receives a set screw 28. The lower end of the set screw 28 rests on a support surface 30 of the lower shell within slot 28 supporting the lower diaphragm 12, as well as the upper diaphragm 10 resting on the lower diaphragm along the horizontal midline 14.

The upper diaphragm 10 includes a laterally opening recess 32 which receives a lug 34 secured to the upper shell 18 by a bolt 36. Access to the bolt and lug is provided in a slot 38 which also registers with the slot 28 of the lower shell 20. A set screw 39 is threaded into a bore of the upper diaphragm adjacent the midline 14 with a clearance, for example, on the order of 0.005–0.007" between the set screw and the lug, with one end of the set screw lying flush with the midline surface of the upper diaphragm 10. This clearance enables generally vertical movement of the upper and lower diaphragms relative to the housing 16 to the limited extent of the clearance. With the upper and lower diaphragms 10 and 12, respectively, lacking positive securement to one another, there is a potential for steam leakage through the horizontal midline joint 14 between those diaphragm halves.

Figure 2:
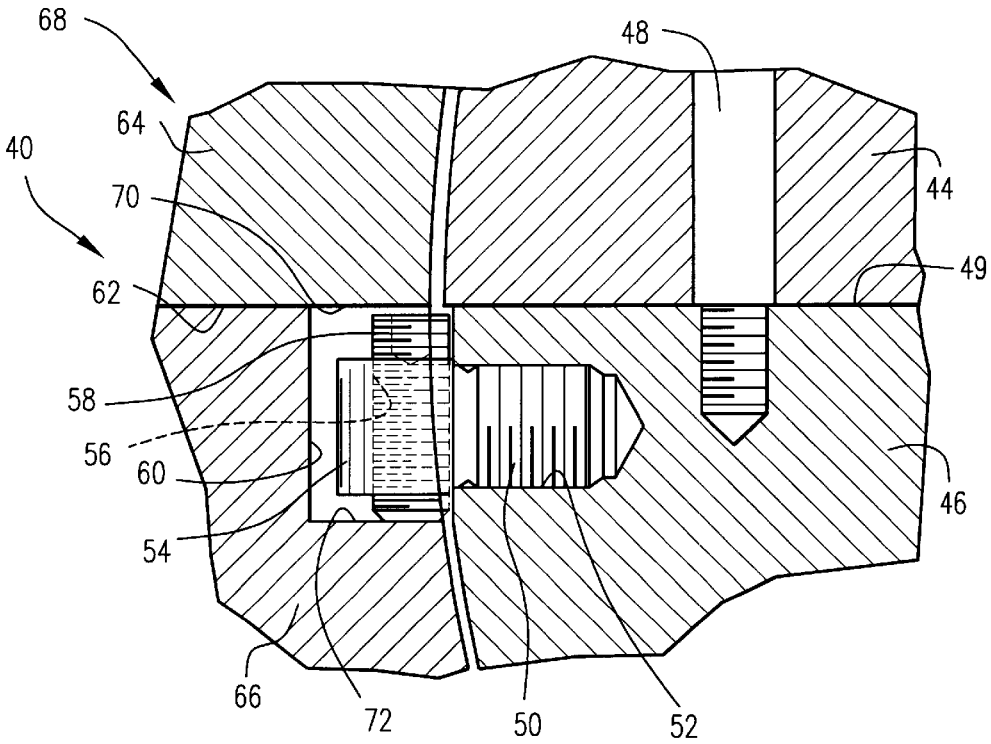
FIGS. 2 and 3 illustrate a screw support system in accordance with a preferred embodiment of the present invention illustrating the system in a static or at-rest condition and a condition with the diaphragm generally vertically elevated a limited predetermined distance relative to the housing.
Figure 3:
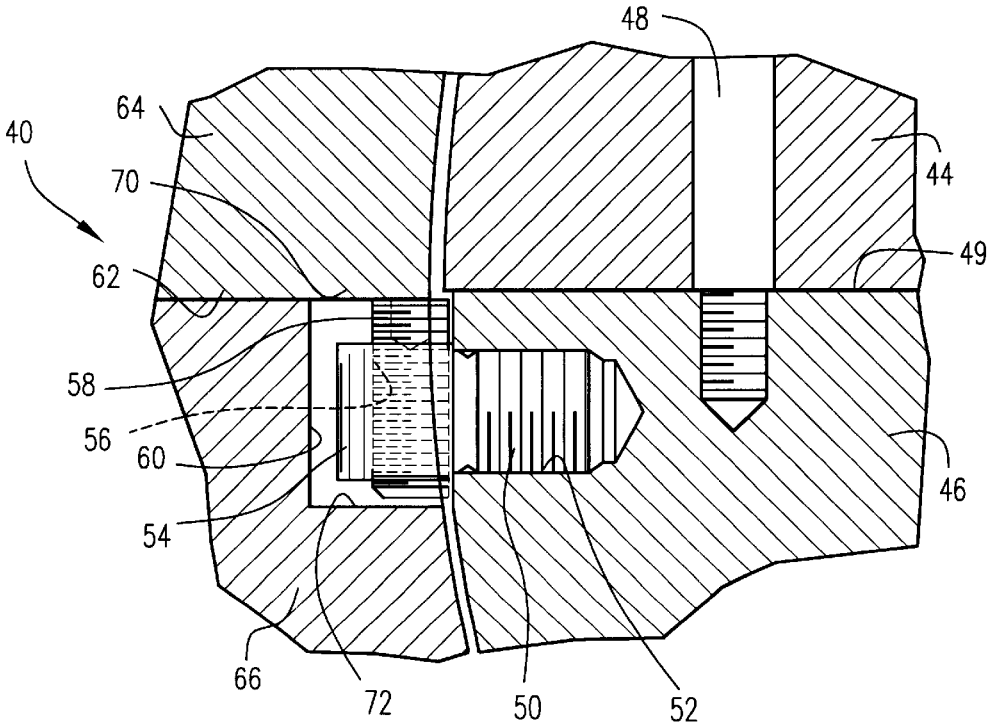

In order to secure the upper and lower diaphragms to one another and thereby minimize or eliminate any potential for steam leakage past the horizontal joint between the diaphragms, while also enabling movement vertically relative to the outer shell, there is provided a novel screw support system, generally designated 40 in FIGS. 2 and 3, having supports 42 adjacent opposite sides of the housing and diaphragms. In these drawing figures, there are illustrated upper and lower diaphragms 44 and 46, respectively, mounting nozzles defined by an annular array of stator vanes, not shown. The upper and lower diaphragms 44 and 46 are secured one to the other by bolts 48 and are joined to one another along a midline 49. Each support 42 includes a support screw 50 threadedly engaged in a threaded bore 52 in respective opposite sides of the lower diaphragm 46. The heads or projections 54 of the support screws 50 are provided with threaded bores 56 for receiving a support element 58, e.g., an elongated set screw. Each head 56 and set screw 58 is provided in a slot 60 opening through a midline 62 between upper and lower shells 64 and 66 of a turbine housing, generally designated 68. As illustrated in both FIGS. 2 and 3, a face portion or stop 70 of the horizontal joint face of the upper shell 64 registers with the slot 60 when the upper and lower shells of the turbine housing are secured to one another. As illustrated in FIG. 2, the set screw is dimensioned or has a length corresponding to the depth of the slot 60 less a clearance, for example, on the order of 0.005–0.007". Thus, with the set screw resting on an abutment 72 at the lower end of slot 60, i.e., a base 72 of slot 60, the upper end of the set screw is spaced back by this clearance distance from the face portion 70 of the upper shell 64 at the horizontal joint.

Referring to FIG. 3, the upper and lower diaphragms 44 and 46 are displaced generally vertically upwardly a distance limited by the clearance between the upper end of the set screw and the portion 70 of the joint face. In FIG. 3, the set screw is engaging the joint face portion 70 of the upper shell, limiting the upward movement of the diaphragm halves relative to the housing 68.

To facilitate installation of the screw support system hereof, the support screws 50 are threadedly engaged in the threaded bores 52 in the opposite sides of the lower diaphragm 46. The lower diaphragm 46 is then lowered onto the lower shell 66 with the heads 54 of the support screws 50 and set screws 58 disposed in the slots 60 of the lower shell. The lower diaphragm 46 thus rests on the lower shell 66 by engagement of the lower end of the set screw 58 and the abutment 72. The upper diaphragm 44 is bolted to the lower diaphragm 46 by bolts 48. To complete the installation, the upper shell 64 is then bolted to the lower shell 66 at the horizontal midline. By properly dimensioning the set screw 58 to provide the clearance between its upper end and the lower face portion 70 of the upper shell 64, the diaphragms are enabled for vertical movement within that limited distance.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A support system for diaphragms of a turbine, comprising:

upper and lower diaphragms secured to one another along a horizontal midline;

a turbine housing including upper and lower outer shells for securement to one another along a midline and in surrounding relation to said diaphragms, said lower shell including slots along respective opposite sides thereof adjacent the midline of said shells;

supports cooperable between said lower diaphragm and said lower shell adjacent the midlines of the shells and diaphragms, respectively, for supporting the diaphragms within said housing;

each said support includes a set screw in said slot adjustable to provide a predetermined clearance between the set screw and a facing portion of the upper shell along said midline, enabling generally vertical joint movement of the upper and lower diaphragms relative to the surrounding housing, said set screw being engageable with the upper shell face portion upon upward displacement of said upper and lower diaphragms within said housing to limit displacement thereof to said clearance.

2. A support system according to claim 1 wherein said upper and lower diaphragms are secured to one another by bolts.

3. A support system according to claim 1 wherein said clearance lies between the set screw and a horizontal midline joint face along the upper shell.

4. A support system according to claim 1 wherein each said support includes a projection from said lower diaphragm along opposite sides thereof and having a threaded bore for receiving said set screw.

5. A support system according to claim 1 wherein said upper and lower diaphragms are bolted to one another.

6. A support system for diaphragms of a turbine, comprising:

upper and lower diaphragms secured to one another along a horizontal midline;

a turbine housing including upper and lower outer shells for securement to one another along a midline and in surrounding relation to said diaphragms;

supports cooperable between said lower diaphragm and said lower shell adjacent the midlines of the shells and diaphragms, respectively, for supporting the diaphragms within said housing;

each said support includes a set screw adjustable to provide a predetermined clearance between the set screw and a portion of the upper shell, enabling generally vertical joint movement of the upper and lower diaphragms relative to the surrounding housing, said set screw being engageable with the upper shell portion upon upward displacement of said upper and lower diaphragms within said housing to limit displacement thereof to said clearance, said clearance lying between the set screw and a horizontal midline joint face along the upper shell.

7. A support system for diaphragms of a turbine, comprising:

upper and lower diaphragms secured to one another along a horizontal midline;

a turbine housing including upper and lower outer shells for securement to one another along a midline and in surrounding relation to said diaphragms;

supports cooperable between said lower diaphragm and said lower shell adjacent the midlines of the shells and diaphragms, respectively, for supporting the diaphragms within said housing;

each said support includes a set screw adjustable to provide a predetermined clearance between the set screw and a portion of the upper shell, enabling generally vertical joint movement of the upper and lower diaphragms relative to the surrounding housing, said set screw being engageable with the upper shell portion upon upward displacement of said upper and lower diaphragms within said housing to limit displacement thereof to said clearance, each said support including a projection from said lower diaphragm along opposite sides thereof and having a threaded bore for receiving said set screw.

8. A support system according to claim 7 including a slot in said lower shell along each of opposite sides thereof adjacent the midline of said shells, said set screw being disposed in said slot with opposite ends engaging a base of said slot and a portion of said upper shell along a horizontal joint face thereof upon closure of the clearance therebetween.

9. A support system for diaphragms of a turbine, comprising:

upper and lower diaphragms secured to one another along a horizontal midline;

a turbine housing including upper and lower outer shells for securement to one another along a midline and in surrounding relation to said diaphragms;

supports cooperable between said lower diaphragm and said lower shell adjacent the midlines of the shells and diaphragms, respectively, for supporting the diaphragms within said housing;

each said support includes a set screw adjustable to provide a predetermined clearance between the set screw and a portion of the upper shell, enabling generally vertical joint movement of the upper and lower diaphragms relative to the surrounding housing, said set screw being engageable with the upper shell portion upon upward displacement of said upper and lower diaphragms within said housing to limit displacement thereof to said clearance, said supports including support screws threaded into opposite sides, respectively, of said lower diaphragm and projecting therefrom into a slot formed in the lower shell, each said support screw having a threaded head in said slot for threadedly receiving said set screw, enabling one end of said screw for support on a base of said slot and an opposite end thereof spaced from said upper shell portion.

10. A support system according to claim 9 wherein said upper and lower diaphragms are bolted to one another.

11. A method of supporting upper and lower diaphragms joined one to the other adjacent a horizontal midline joint and disposed within a housing having upper and lower shells surrounding said diaphragms and joined to one another adjacent a horizontal midline, comprising the steps of:

supporting the upper and lower diaphragms from supports projecting outwardly along opposite sides of the lower diaphragm and engaging the lower shell; and limiting upward displacement of the upper and lower diaphragms within the housing by spacing an element carried by said lower diaphragm a predetermined clearance from a stop carried by said upper shell;

the step of supporting including threading a support screw into opposite sides of the lower diaphragm and providing a set screw cooperable with said lower diaphragm and said lower shell for supporting said shell.

12. A method according to claim 11 including adjusting said set screws to a predetermined clearance between said set screws and said stops.

13. A method according to claim 12 including providing an abutment on said lower shell spaced below the horizontal midline of said shells, providing a set screw having a length corresponding to the distance between the abutment and a portion of the horizontal midline between said shells less said clearance whereby the diaphragms are supported by the lower shell for upward movement said limited distance.

14. A method according to claim 13 including providing a threaded aperture in said support screw and threading said set screw in said aperture.

* * * * *